US010731468B2

(12) United States Patent
Han

(10) Patent No.: US 10,731,468 B2
(45) Date of Patent: Aug. 4, 2020

(54) GAS TURBINE

(71) Applicant: DOOSAN HEAVY INDUSTRIES & CONSTRUCTION CO., LTD., Changwon-si, Gyeongsangnam-do (KR)

(72) Inventor: Sang Sup Han, Daejeon (KR)

(73) Assignee: Doosan Heavy Industries Construction Co., Ltd., Gyeongsangnam-do (KR)

( * ) Notice: Subject to any disclaimer, the term of this patent is extended or adjusted under 35 U.S.C. 154(b) by 162 days.

(21) Appl. No.: 15/814,120

(22) Filed: Nov. 15, 2017

(65) Prior Publication Data

US 2018/0135416 A1 May 17, 2018

(30) Foreign Application Priority Data

Nov. 17, 2016 (KR) ..... 10-2016-0153360

(51) Int. Cl.

| | |
|---|---|
| ***F01D 5/10*** | (2006.01) |
| ***F01D 5/08*** | (2006.01) |
| ***F01D 25/16*** | (2006.01) |
| ***F01D 5/06*** | (2006.01) |
| ***F01D 25/12*** | (2006.01) |

(52) U.S. Cl.

CPC ..... *F01D 5/10* (2013.01); *F01D 5/066* (2013.01); *F01D 5/085* (2013.01); *F01D 25/12* (2013.01); *F01D 25/164* (2013.01); *F05D 2220/32* (2013.01); *F05D 2250/311* (2013.01); *F05D 2260/20* (2013.01); *F05D 2260/96* (2013.01); *F05D 2300/516* (2013.01)

(58) Field of Classification Search

CPC ..... F01D 5/025; F01D 5/026; F01D 5/066; F01D 5/081; F01D 5/085; F01D 5/10; F01D 25/164

See application file for complete search history.

(56) References Cited

U.S. PATENT DOCUMENTS

| | | | |
|---|---|---|---|
| 8,506,239 | B2 | 8/2013 | Benkler et al. |
| 2009/0282679 | A1 | 11/2009 | Mons et al. |
| 2015/0198044 | A1 | 7/2015 | Jung |

FOREIGN PATENT DOCUMENTS

| | | | |
|---|---|---|---|
| EP | 1970528 | A1 | 9/2008 |
| JP | 2010-520968 | A | 6/2010 |

(Continued)

OTHER PUBLICATIONS

English Machine Translation of EP1970528 (Year: 2007).*

(Continued)

*Primary Examiner* — Richard A Edgar
*Assistant Examiner* — Michael K. Reitz
(74) *Attorney, Agent, or Firm* — Invenstone Patent, LLC

(57) ABSTRACT

A gas turbine includes a compressor rotor having a plurality of compressor rotor disks installed therein; a turbine rotor having a plurality of turbine rotor disks installed therein; a connection part connecting the compressor rotor and the turbine rotor to each other; a tie rod extended through the central axes of the plurality of compressor rotor disks and the central axes of the plurality of turbine rotor disks; and a clamping member forced onto the tie rod in the an axial direction of the tie rod so as to be rotated with the tie rod, and relatively rotated with respect to the an inner circumferential surface of the connection part, thereby damping vibration and shock.

14 Claims, 11 Drawing Sheets

(56) References Cited

FOREIGN PATENT DOCUMENTS

| | | | |
|---|---|---|---|
| JP | 2015-132265 | A | 7/2015 |
| KR | 10-1675269 | B1 | 11/2016 |

OTHER PUBLICATIONS

Office Action dated Sep. 6, 2018 in Japanese Application No. 2017-218533.
European Search Report dated Apr. 3, 2018 in European Application No. 17201894.7.

* cited by examiner

GAS TURBINE

CROSS-REFERENCE TO RELATED APPLICATION

This application claims the benefit of Korean Patent Application No. 10-2016-0153360, filed Nov. 17, 2016, the disclosure of which is incorporated herein by reference in its entirety.

BACKGROUND OF THE INVENTION

Field of the Invention

Exemplary embodiments of the present invention relate to a gas turbine, and more particularly, a clamping member coupled to a tie rod of a gas turbine.

Description of the Related Art

In general, a gas turbine refers to a kind of internal combustion engine which converts thermal energy into mechanical energy while expanding high-temperature and high-pressure combustion gas in a turbine, the high-temperature and high-pressure combustion gas being generated by burning a mixture of air and fuel, the air being compressed to high pressure by a compressor. The compressor and the turbine acquire a rotational force through a rotor.

The gas turbine includes a plurality of compressor rotor disks each having a plurality of compressor blades arranged on the outer circumferential surface thereof, in order to construct a compressor rotor and a turbine rotor.

The gas turbine further includes a tie bolt for connecting the compressor rotor disks to each other such that the compressor rotor disks are rotated together. The tie bolt also connects a plurality of turbine rotor disks to each other such that the turbine rotor disks are rotated together, the plurality of turbine rotor disks each having a plurality of turbine blades arranged thereon.

The tie bolt is fastened through the central portions of the compressor rotor disks and the turbine rotor disks.

Recently, however, the increase in size and efficiency of gas turbines has raised the whole lengths of the gas turbines. Therefore, the tie bolt which is rotated at high speed with the compressor rotor and the turbine rotor of the gas turbine may not be stably supported.

In particular, it is not easy to install a unit capable of stably supporting the rotating tie bolt in a space where combustors are radially arranged between the compressor rotor and the turbine rotor along the center axis of the gas turbine.

The tie bolt is extended through the compressor rotor having the plurality of compressor rotor disks and the turbine rotor having the plurality of turbine rotor disks.

Recently, a rotor assembly has been suggested, which supports a tie bolt through a support wheel installed in a hollow shaft that forcibly connects a compressor rotor and a turbine rotor to each other, when fastening the compressor rotor and the turbine rotor using the tie bolt, a compressor-side rotor fastening member and a turbine-side rotor fastening member.

However, the rotor assembly has difficulties in forming a flow path in the support wheel, the flow path being used for transferring low-temperature air extracted from the compressor rotor to the high-temperature turbine rotor in order to utilize the low-temperature air as cooling air of the turbine rotor.

RELATED ART DOCUMENT

Patent Document (Patent Document) US Patent Registration No. 8506239B2

SUMMARY OF THE INVENTION

The present invention has been made in view of the above problems, and the present invention provides a gas turbine which includes a clamping member which is inserted onto a tie rod in order to minimize vibration and shock generated through rotation of the tie rod, while performing damping and cooling at the same time.

Other aspects of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with one aspect of the present invention, a gas turbine may include: a compressor rotor having a plurality of compressor rotor disks installed therein; a turbine rotor having a plurality of turbine rotor disks installed therein; a connection part connecting the compressor rotor and the turbine rotor to each other; a tie rod extended through central axes of the plurality of compressor rotor disks and central axes of the plurality of turbine rotor disks; and a clamping member forced onto the tie rod in an radial direction of the tie rod so as to be rotated with the tie rod, and relatively rotated with respect to an inner circumferential surface of the connection part, wherein a cooling air is moved from the compressor rotor to the turbine rotor through an axial inside of the clamping member and a circumferential edge of the clamping member at the same time.

The clamping member may include: an inner ring pressed against an outer circumferential surface of the tie rod; a plurality of support parts arranged at predetermined intervals such that one ends thereof are connected to an outer circumferential surface of the inner ring and the other ends thereof are extended toward an outside along a circumferential direction of the inner ring; and a plurality of stiffeners connected to the other ends of the support parts, respectively, and arranged along the circumferential direction of the inner ring while forming a concentric circle around a center of the inner ring.

The support parts may be obliquely extended from the inner ring toward the respective stiffeners, when the clamping member is seen from the front.

The support parts may be extended from the circumferential direction of the inner ring toward the respective stiffeners in a normal direction perpendicular to the circumferential direction.

The stiffeners may have a slope corresponding to a slope of the inner circumferential surface of the connection part.

The stiffeners may be top-bottom and left-right symmetrical with respect to the center of the inner ring.

Each of the stiffeners may maintain a clearance from another neighboring stiffener.

The plurality of stiffeners may have the same clearance therebetween.

The clearance may be decreased toward the turbine rotor.

The inner ring may have a plurality of grooves formed in the circumferential direction thereof, such that the support parts are inserted into the respective grooves.

The support part may be connected to a center of a bottom surface of the stiffener.

A surface of the stiffener, which is relatively rotated with respect to the connection part, may be processed to have low surface roughness.

In accordance with another aspect of the present invention, a gas turbine may include: a compressor rotor having a plurality of compressor rotor disks installed therein; a turbine rotor having a plurality of turbine rotor disks installed therein; a connection part connecting the compressor rotor and the turbine rotor to each other; a tie rod extended through central axes of the plurality of compressor rotor disks and central axes of the plurality of turbine rotor disks; and a clamping member forced onto the tie rod in an radial direction of the tie rod so as to be rotated with the tie rod, and relatively rotated with respect to an inner circumferential surface of the connection part, wherein the clamping member includes damping parts which damp an eternal force when the external force is applied.

The clamping member may include: an inner ring pressed against an outer circumferential surface of the tie rod; a plurality of extensions arranged at predetermined intervals and extended from ends of the damping parts connected to an outer circumferential surface of the inner ring toward an outside along a circumferential direction of the inner ring; and a plurality of stiffeners connected to ends of the extensions, respectively, and arranged along the circumferential direction while forming a concentric circle around a center of the inner ring.

Each of the damping parts may include a first damping part having one end fixed to a lower end of the corresponding extension and the other end fixed to the outer circumferential surface of the inner ring.

The damping part may further include second damping parts having one ends fixed to left and right surfaces of the extension, respectively, and the other ends fixed to the outer circumferential surface of the inner ring.

The first and second damping parts may have different elastic restoring forces.

When the stiffener is moved in the circumferential direction of the inner ring, any one of the second damping parts may be elastically compressed, and the other of the second damping parts may be extended.

The first damping part may be inserted and coupled to the inner ring.

The damping parts may be extended in a zigzag manner from the inner ring toward the respective extensions, and have a width and thickness corresponding to a width of the inner ring.

The damping parts may be made of a metal or high-elasticity metal which retains an elastic restoring force.

It is to be understood that both the foregoing general description and the following detailed description of the present invention are exemplary and explanatory and are intended to provide further explanation of the invention as claimed.

BRIEF DESCRIPTION OF THE DRAWINGS

The above and other features of the present invention will be more clearly understood from the following detailed description taken in conjunction with the accompanying drawings, in which.

DESCRIPTION OF SPECIFIC EMBODIMENTS

Hereafter, a gas turbine according to a first embodiment of the present invention will be described with reference to the accompanying drawings. For reference, FIG. 1 illustrates a gas turbine and a clamping member according to a first embodiment of the present invention, FIG. 2 is a front view of the clamping member according to the first embodiment of the present invention, and FIG. 3 is a perspective view illustrating a modification of the clamping member according to the first embodiment of the present invention.

Figure 1:
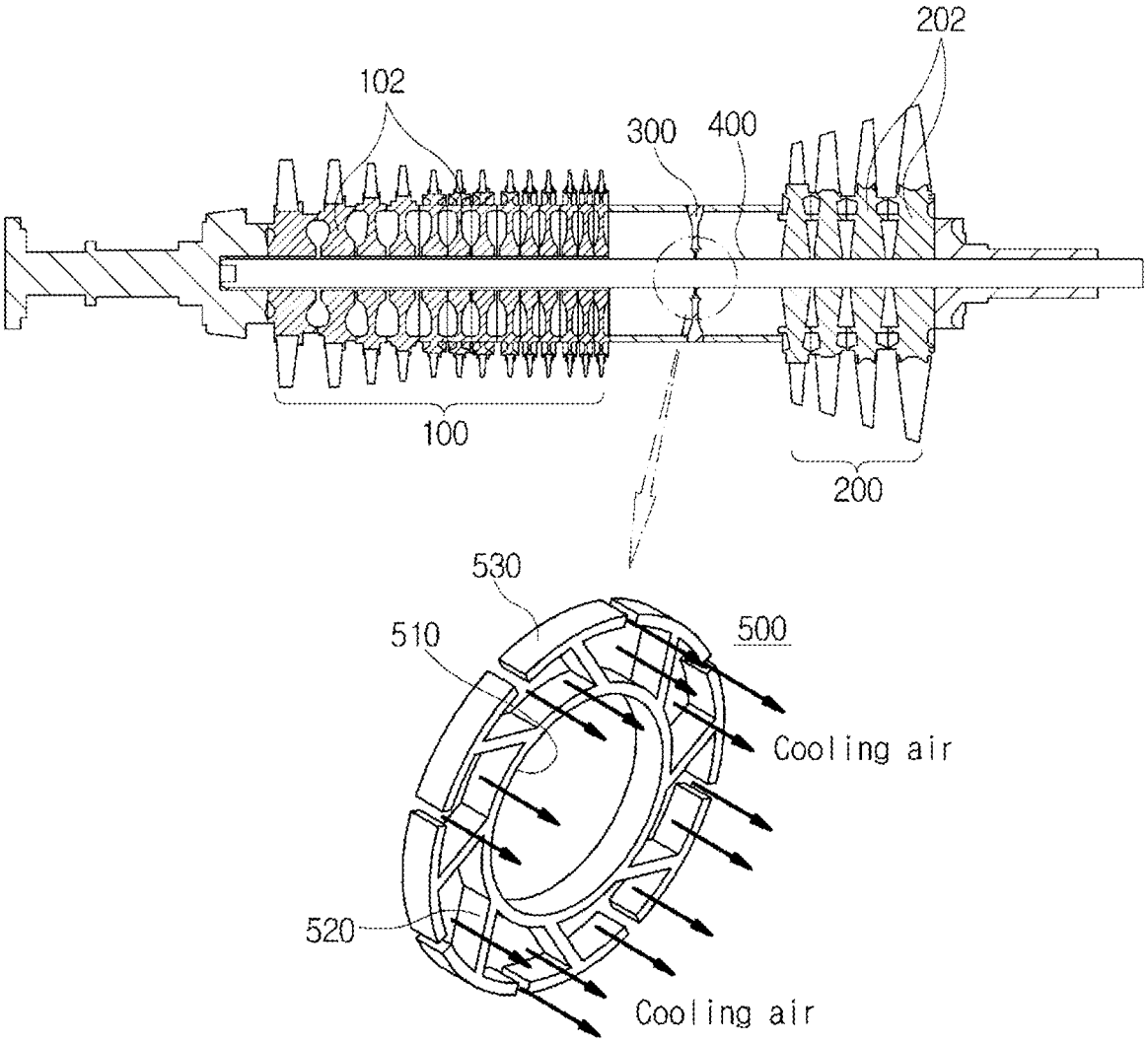
FIG. 1 illustrates a gas turbine and a clamping member according to a first embodiment of the present invention.
Figure 2:
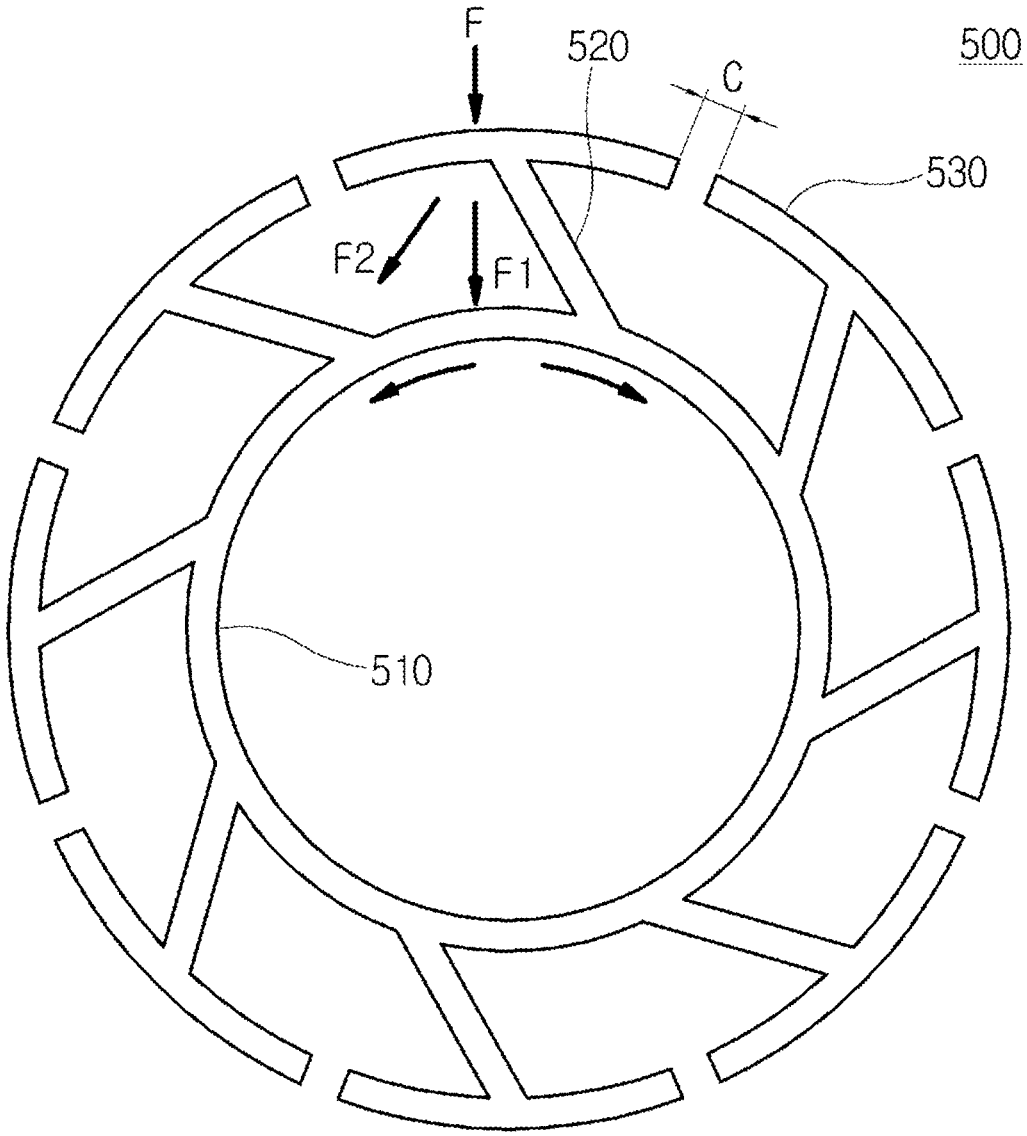
FIG. 2 is a front view of the clamping member according to the first embodiment of the present invention.
Figure 3:
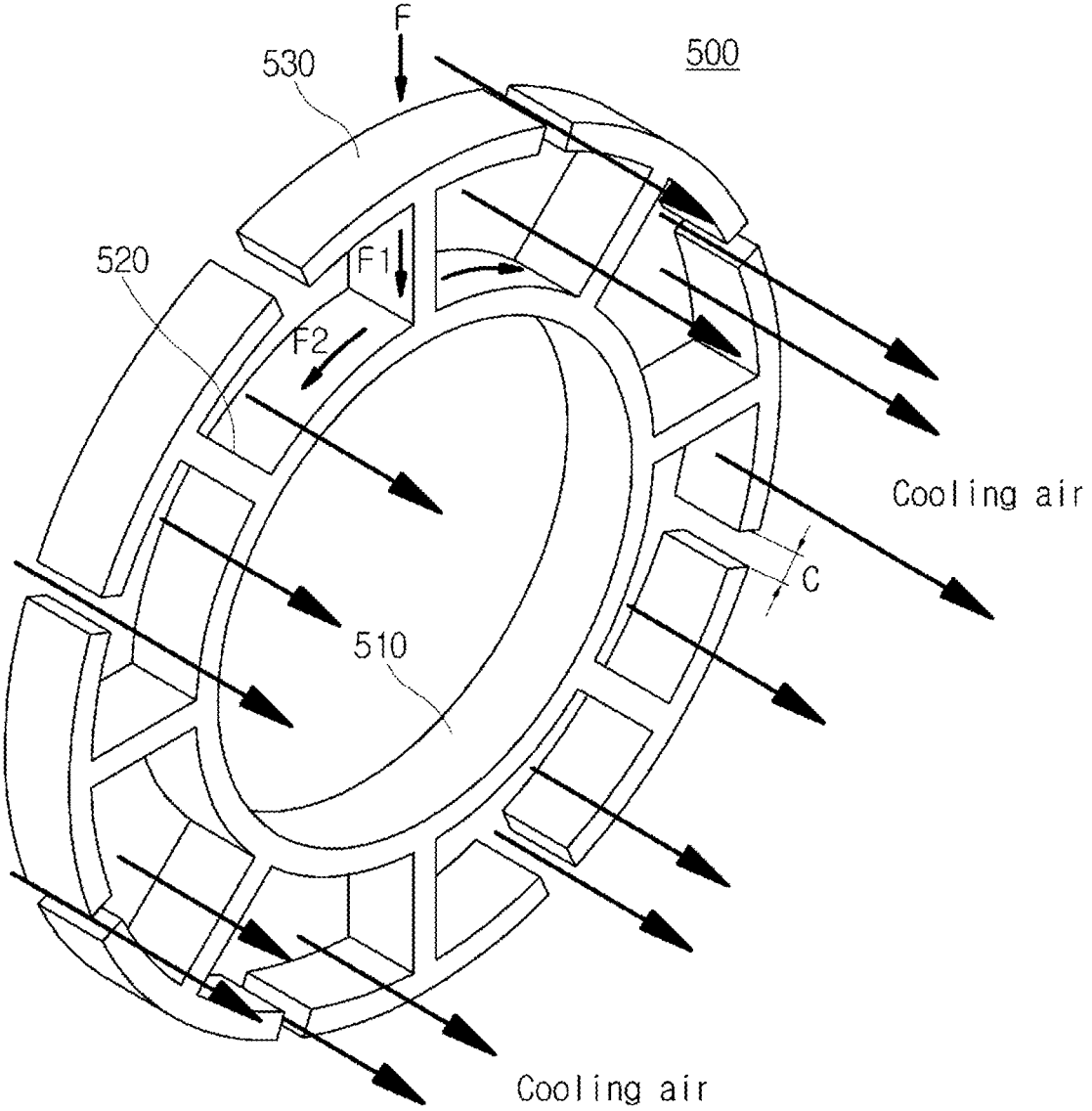
FIGS. 3 and 4 are perspective views illustrating a modification of the clamping member according to the first embodiment of the present invention.

Referring to FIGS. 1 and 2, the gas turbine according to the first embodiment of the present invention includes a compressor rotor 100, a turbine rotor 200, a connection part 300, a tie rod 400, and a clamping member 500. The compressor rotor 100 includes a plurality of compressor rotor disks 102, the turbine rotor 200 includes a plurality of turbine rotor disks 202, the connection part 300 is installed to connect the compressor rotor 100 and the turbine rotor 200 to each other, the tie rod 400 is extended through the center axes of the plurality of compressor rotor disks 102 and the center axes of the plurality of turbine rotor disks 202, and the clamping member 500 is forced onto the tie rod 400 in the axial direction of the tie rod 400 so as to be rotated with the tie rod 400, and relatively rotated with respect to the inner circumferential surface of the connection part 300.

The clamping member 500 allows cooling air to move from the compressor rotor 100 to the turbine rotor 200 through the axial inside of the clamping member 500 and the circumferential edge of the clamping member 500 at the same time. Thus, a large amount of cooling air can be stably moved through the clamping member 500.

The clamping member 500 includes an inner ring 510, a plurality of support parts 520, and a plurality of stiffeners 530. The inner ring 510 is pressed against the outer circumferential surface of the tie rod 400, the plurality of support parts 520 are arranged at predetermined intervals on the inner ring 510 such that one ends thereof are connected to the outer circumferential surface of the inner ring 510 and the other ends thereof are extended to the outside along the circumferential direction of the inner ring 510, and the plurality of stiffeners 530 are connected to the other ends of the respective support parts 520, and arranged along the circumferential direction while forming a concentric circle around the center of the inner ring 510.

The inner ring 510 may be coupled to the tie rod 400 through a shrink fit method, and have an inner diameter corresponding to the outer diameter of the tie rod 400 such that the inner circumferential surface thereof is in contact with the outer circumferential surface of the tie rod 400. As illustrated in FIG. 2, the inner ring 510 is formed in a ring shape with a predetermined diameter.

The plurality of support parts 520 may be radially arranged on the outer circumferential surface of the inner ring 510 along the circumferential direction, and obliquely extended from the respective stiffeners 530 toward the inner ring 510 when the clamping member 500 is seen from the front.

The support parts 520 may connect the inner ring 510 to the respective stiffeners 530 in various manners. In the present embodiment, the support parts 520 may be obliquely extended from the respective stiffeners 530 toward one side in order to improve a damping force in the center direction of the inner ring 510.

Since the support parts 520 are obliquely connected to the inner ring 510 in order to maintain a stable damping force, the locations of the stiffeners 530 connected to the support parts 520 may be shifted in the circumferential direction through the rotation of the tie rod 400.

In this case, the damping force may be changed depending on the inclination angle of the support part 520. However, when an external force applied from the stiffener 530 toward the support part 520 is represented by F, the external force F is divided into forces F1 and F2 by the inclination angle of the support part 520, and then transferred to the inner ring 510.

The force F1 which is an external force applied in the same direction as the external force F is transferred to the inner ring 510 through the support part 520. Then, a part of the force F1 is transferred toward the axial center, and the other part of the force F1 is damped while being spread in the circumferential direction of the inner ring 510 as indicated by arrows.

The force F2 is obliquely applied to the left through the stiffener 530 as illustrated in FIG. 2.

For example, the force F2 may be applied in the 9 or 10 o'clock direction based on the clockwise direction. In this case, the support part 520 may damp the external force while being bent at a predetermined angle in the circumferential direction, and reduce a shock applied to the clamping member 500.

Therefore, even an external force applied from any position while the tie rod 400 is rotated can be stably damped through the coupling relation and the arrangement relation between the stiffeners 530 and the support parts 520 which are installed in the circumferential direction of the clamping member 500.

The above-described embodiment is based on the case in which the external force F is applied to the stiffener 530 positioned in the 12 o'clock direction of the clamping member 500. However, when the clamping member 500 is coupled to the tie rod 400 and then rotated with the tie rod 400, the clamping member 500 can reduce a shock even though an external force is applied to a plurality of stiffeners 530 or an external force is applied to a stiffener located at an unspecified position.

Each of the stiffeners 530 according to the present embodiment maintains a clearance C from another neighboring stiffener 530 in the circumferential direction. Since the clearance C provides a space through which cooling air can be moved, the clamping member 500 can perform a damping function and a cooling function at the same time.

Since the stiffeners 530 are connected to the respective support parts 520 connected to the inner ring 510, another neighboring stiffener is located in the one or 11 o'clock direction based on the stiffener 530 located in the 12 o'clock direction.

Since the stiffener 530 located in the 12 o'clock direction is separated from another neighboring stiffener located in the circumferential direction, the plurality of stiffeners can independently perform damping in the circumferential direction.

The clearance between the stiffener 530 and the neighboring stiffener is equally maintained among the plurality of stiffeners arranged in the circumferential direction. In this case, since the plurality of stiffeners are separated at even intervals from each other regardless of the locations thereof, the stiffener 530 may be moved by a distance corresponding to the clearance even when the stiffener 530 is moved toward the neighboring stiffener located at the left or right side thereof in the circumferential direction.

Therefore, the stiffener 530 can perform damping more stably through the movement in the circumferential direction. The clearance may be changed to a different clearance.

Figure 4:
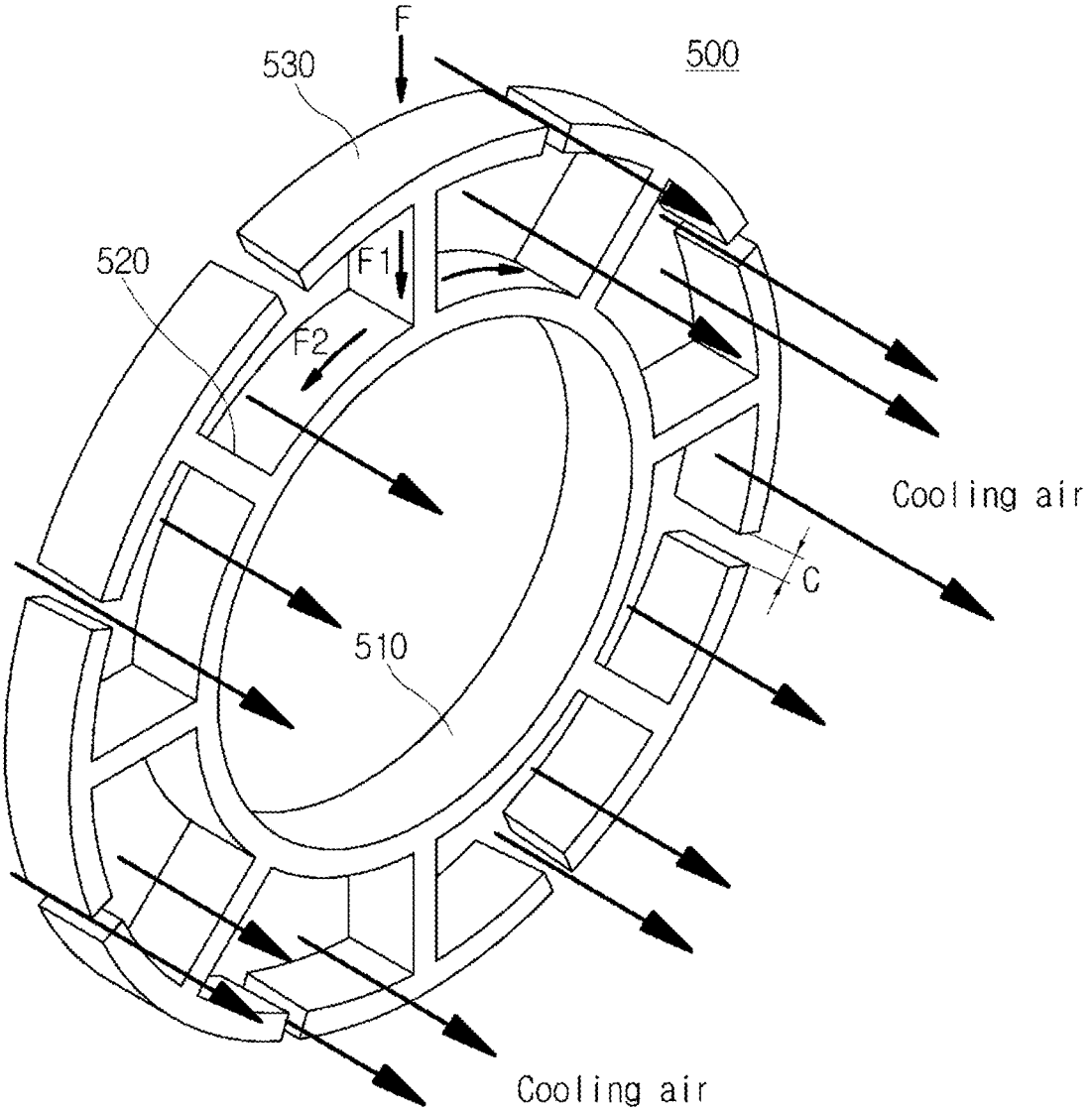

Referring to FIGS. 3 to 4, cooling air can be moved from the compressor rotor 100 to the turbine rotor 200 through the clearance C between the stiffeners. The cooling performance can be improved. The clearance is set to a constant width from the compressor rotor 100 toward the turbine rotor 200 when the clamping member 500 is seen from the top.

Unlike the above-described embodiment, the clearance C may have a width that decreases toward the turbine rotor 200 from the compressor rotor 100. In this case, the moving speed of the cooling air is increased from the compressor rotor 100 toward the turbine rotor 200. Thus, a large amount of cooling air can be stably supplied while the moving speed and flow rate of the cooling air are increased.

The stiffener 530 according to the present embodiment has a slope corresponding to the slope of the inner circumferential surface of the connection part 300 (refer to FIG. 1) when seen from the front. For example, since the stiffener 530 is rounded with a curvature corresponding to the curvature of the inner circumferential surface of the ring-shaped connection part 300, friction and unnecessary noise can be minimized even when the connection part 300 is coupled to the tie rod 400 and then rotated with the tie rod 400. For reference, FIG. 1 illustrates a cross-section of the connection part 300. However, when FIG. 1 is specified into a three-dimensional drawing, the connection part 300 has a diameter and curvature corresponding to the outer circumferential surface of the stiffener 530.

The stiffeners 530 according to the present embodiment are arranged so as to be top-bottom and left-right symmetrical with respect to the center of the inner ring 510. In particular, since the locations at which the support parts 520 are connected to the inner ring 510 are top-bottom and left-right symmetrical with each other, the stiffeners 530 are also top-bottom and left-right symmetrical with each other.

In this case, when an external force is transferred through the stiffeners 530 and the support parts 520, the external force may not be concentrated in a specific direction, but evenly supported and distributed, which makes it possible to improve the stability.

In the present embodiment, the support part 520 is connected to the center of the bottom surface of the stiffener 530. The location where the support part 520 is connected is set based on the supposition that an external force is applied to the center of the outer circumferential surface of the stiffener 530.

The support part 520 has an I-shaped cross-section, but may have a different cross-section such as a Y-shaped or T-shaped cross-section. The support part 520 is not limited to the shape illustrated in FIG. 3.

Figure 5:
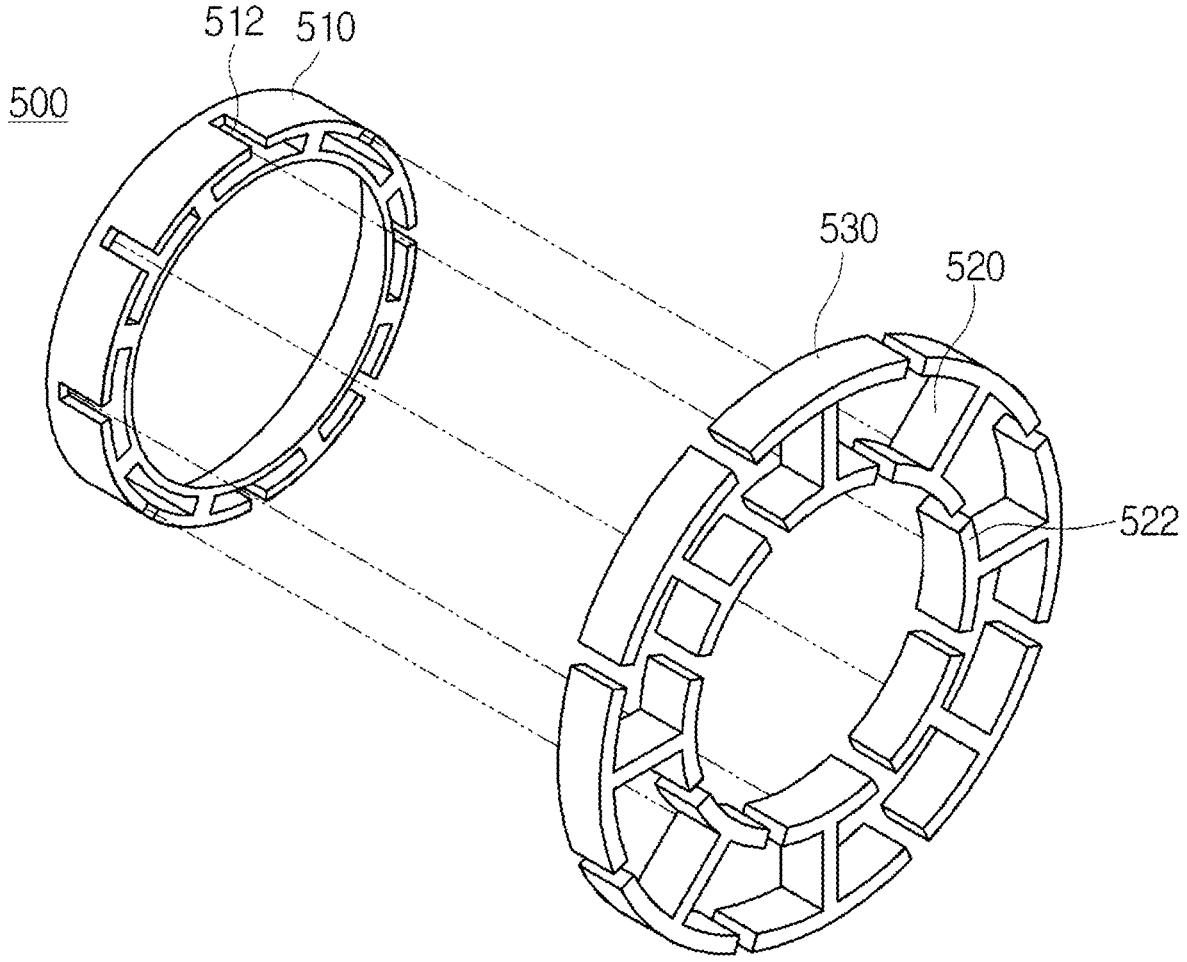
FIG. 5 is a perspective view illustrating that support parts are coupled to grooves formed in the clamping member according to the first embodiment of the present invention.

Referring to FIG. 5, the inner ring 510 according to the present embodiment has a plurality of grooves 512 formed in the circumferential direction thereof, such that the support parts 520 are inserted into the respective grooves 512. The grooves 512 are formed in the outer circumferential surface in order to maintain a stable coupling of the support parts 520.

The groove 512 may be formed in different shapes other than the shape illustrated in FIG. 5, and the shape of the groove 512 or the support part 520 may be changed in such a manner that the support part 520 is more stably coupled to the groove 512.

For example, the support part 520 may be formed in a T-shape such that a temporarily fixed state thereof is maintained until the support part 520 is welded after being inserted into the groove 512. The support part 520 has an insertion piece 522 formed at the bottom thereof. In this case, since the groove 512 has a shape corresponding to the cross-section of the low portion of the support part 520, the support part 520 can be stably inserted into the groove 512.

The direction in which the support part 520 is inserted into the groove 512 may not be limited to the direction illustrated in FIG. 5, but changed to a different direction. Since the insertion piece 522 of the support part 520 is inserted into the groove 512 while pressing against the groove 512, the support part 520 can be coupled to the groove 512 so as not to be separated from the groove 512.

The support part 520 can be stably fixed through welding.

The surface of the stiffener 530, which is relatively rotated with respect to the connection part 300, may be processed to have a low surface roughness. When the clamping member 500 is rotated by the tie rod 400, friction may occur between the stiffener 530 and the inner circumferential surface of the connection part 300. The friction may occur on the outer circumferential surface of the stiffener 530. When the outer circumferential surface is processed to have a low surface roughness, the friction can be reduced. Thus, noise can be minimized.

Therefore, the damping ability of the clamping member 500 can be improved, while friction generated during rotation is minimized.

Figure 6:
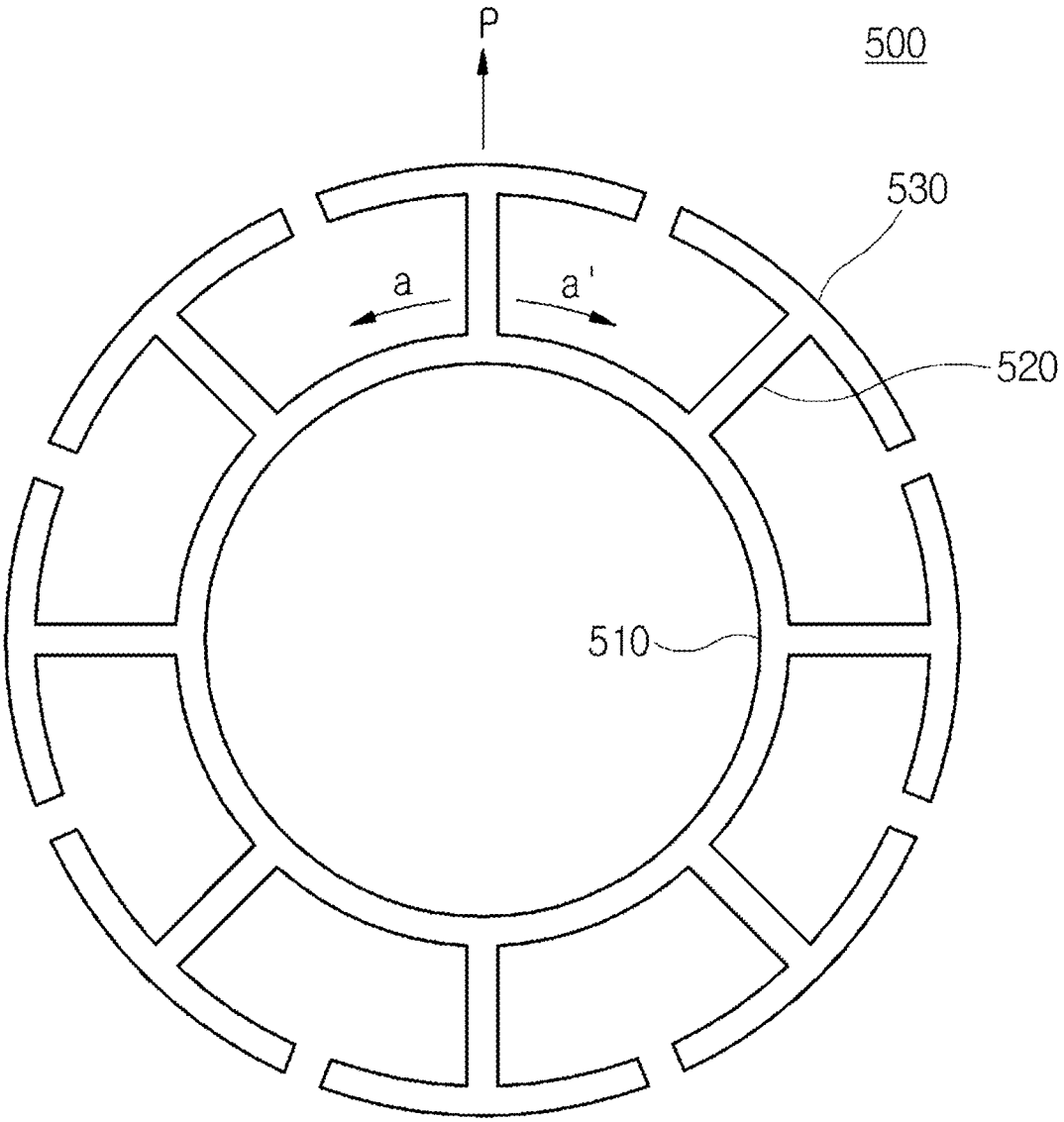
FIG. 6 is a front view of FIG. 3.

Referring to FIG. 6, the clamping member 500 according to the present embodiment includes the plurality of support parts 520 extended from the outer circumference of the inner ring 510 toward the respective stiffeners 530 in the normal direction P.

The normal direction may indicate the direction in which the support part 520 is perpendicular to virtual lines a and a' drawn in a tangential direction on the circumference of the inner ring 510.

The direction corresponds to an outward direction in which the stiffener 530 is located. As illustrated in FIG. 6, the plurality of support parts 520 are arranged at predetermined intervals in the circumferential direction of the inner ring 510 while facing the outside in the normal direction.

In this case, when the external force F is applied to the stiffener 530 as illustrated in FIG. 3, damping is performed while the force F1 is applied along the support part 520 and the force F2 is transferred in the circumferential direction of the inner ring 510 to which the support part 520 is connected.

The support part 520 is extended from the outer circumferential surface of the inner ring 510 toward the stiffener 530 in the normal direction. Thus, even when an external force is applied in any directions, the support part 520 can stably damp the external force. Therefore, the damping force of the clamping member 500 can be improved.

Hence, the external force transferred to the tie rod 400 can be reduced, and unnecessary vibration and noise can be minimized.

Hereafter, a gas turbine according to a second embodiment of the present invention will be described with reference to the accompanying drawings.

Figure 7:
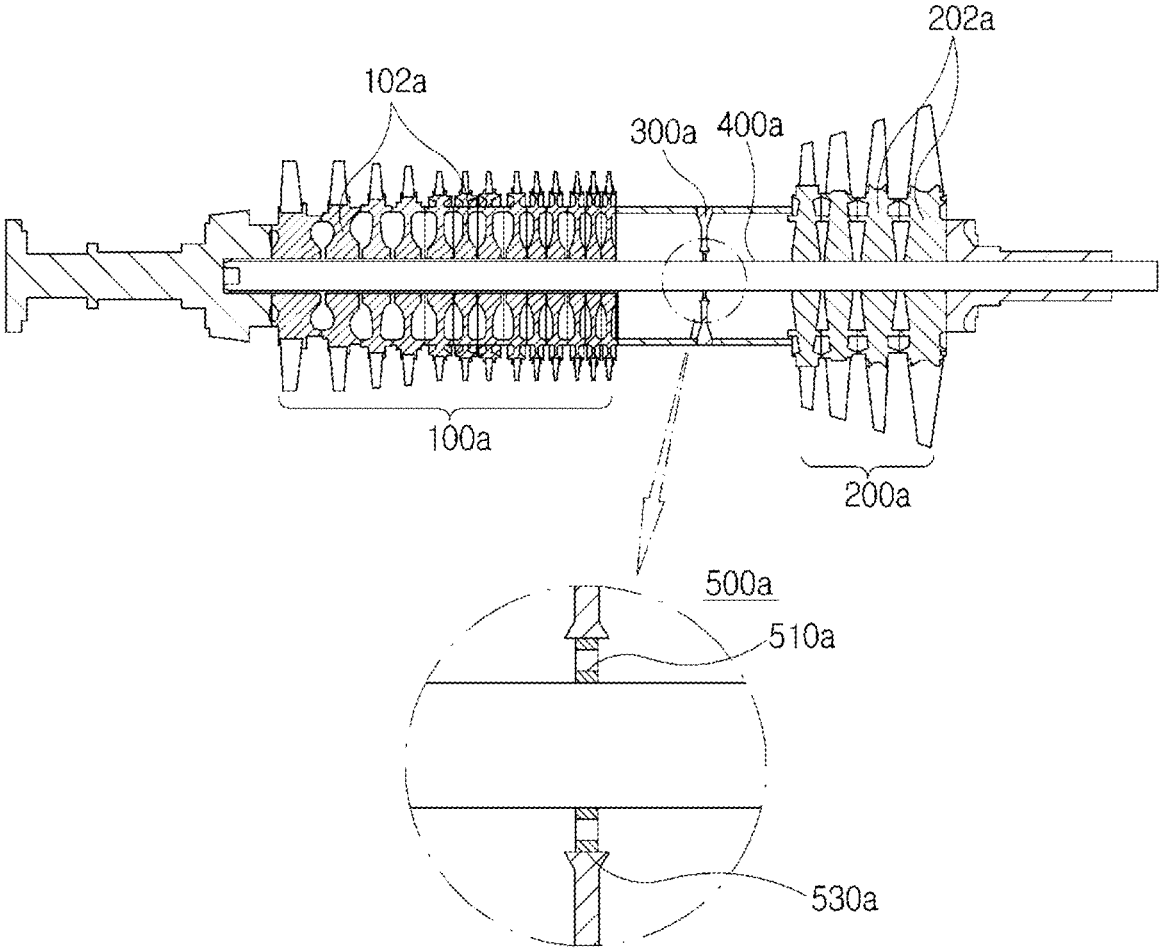
FIG. 7 simply illustrates the structure of a gas turbine according to a second embodiment of the present invention.

Referring to FIG. 7, the gas turbine according to the second embodiment of the present invention includes a compressor rotor 100*a*, a turbine rotor 200*a*, a connection part 300*a*, a tie rod 400*a*, and a clamping member 500*a*. The compressor rotor 100*a* includes a plurality of compressor rotor disks 102*a*, the turbine rotor 200*a* includes a plurality of turbine rotor disks 202*a*, the connection part 300*a* connects the compressor rotor 100*a* and the turbine rotor 200*a* to each other, the tie rod 400*a* is extended through the center axes of the plurality of compressor rotor disks 102*a* and the center axes of the plurality of turbine rotor disks 202*a*, and the clamping member 500*a* is forced onto the tie rod 400*a* in the axial direction of the tie rod 400*a* so as to be rotated with the tie rod 400*a*, and relatively rotated with respect to the inner circumferential surface of the connection part 300*a*.

The clamping member 500*a* allows cooling air to move from the compressor rotor 100*a* to the turbine rotor 200*a* through the axial inside of the clamping member 500*a* and the circumferential edge of the clamping member 500*a* at the same time.

The clamping member 500*a* according to the present embodiment includes an inner ring 510*a*, a plurality of extensions 520*a* and a plurality of stiffeners 530*a*. The inner ring 510*a* is pressed against the outer circumferential surface of the tie rod 400*a*, the plurality of extensions 520*a* are arranged at predetermined intervals such that one ends thereof are connected to the outer circumferential surface of the inner ring 510*a* and the other ends thereof are extended to the outside in the circumferential direction of the inner ring 510*a*, and the plurality of stiffeners 530 are connected to the other ends of the extensions 520*a* and arranged along the circumferential direction while forming a concentric circle around the center of the inner ring 510*a*.

Figure 8:
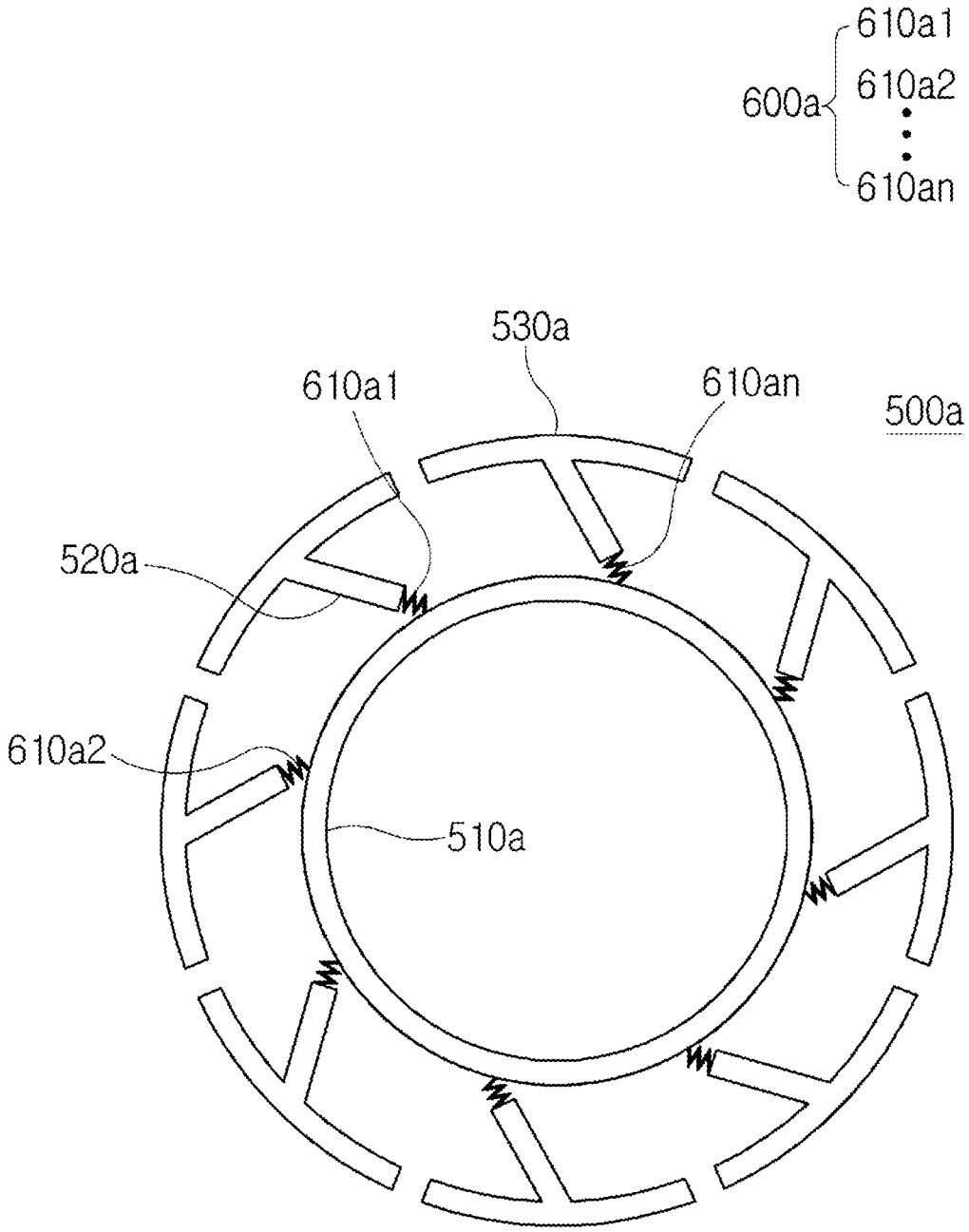
FIGS. 8 to 10 are perspective views illustrating various examples of a damping part included in a clamping member according to the second embodiment of the present invention.

The inner ring 510*a* may be coupled to the tie rod 400*a* through a shrink fit method, for example, and have an inner diameter corresponding to the outer diameter of the tie rod 400*a*. As illustrated in FIG. 8, the inner ring 510*a* may have a predetermined diameter.

The plurality of extensions 520*a* may be obliquely extended toward the respective stiffeners 530*a* from the inner ring 510*a* along the circumferential direction of the inner ring 510*a*, when the clamping member 500*a* is seen from the front.

The extensions 520*a* connect the inner ring 510*a* and the respective stiffeners 530*a* in various manners. In the present embodiment, the extensions 520*a* are obliquely extended in order to improve a damping force toward the center of the inner ring 510*a* from the stiffeners 530*a*, according to the rotation of the tie rod 400*a*.

Since the extensions 520*a* are obliquely connected to the inner ring 510*a* in order to maintain a damping force, the positions of the stiffeners 530*a* connected to the extensions 520*a* may be shifted in the circumferential direction according to the rotation of the tie rod 400*a*.

Figure 9:
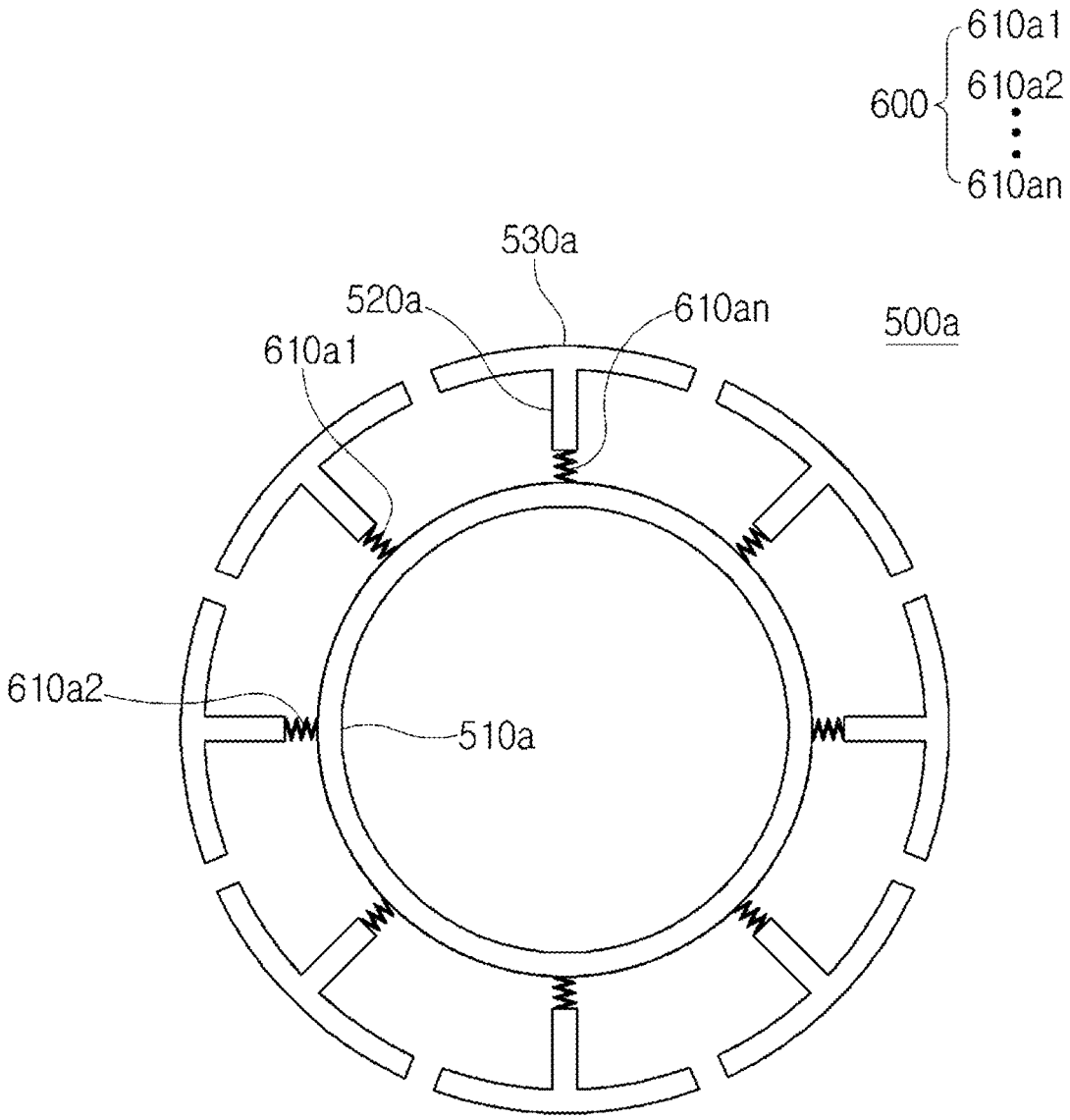

Referring to FIGS. 8 and 9, the clamping member 500*a* according to the present embodiment includes a damping part 600*a* for damping a force applied from the outside. The damping part 600*a* has one end fixed to the lower end of the extension 520*a* and the other end fixed to the outer circumferential surface of the inner ring 510*a*.

The damping part 600*a* includes a plurality of unit damping part 600*a*1 to 600*an* which correspond to the respective stiffeners and are formed at predetermined intervals along the outer circumferential surface of the inner ring 510*a*.

The reference numerals of the unit damping parts 610*a*1 to 610*an* may be sequentially set in the clockwise direction from the unit damping part 610*a*1 located at the 11 o'clock position.

At this time, any one of a spring and plate spring which can damp a force applied from the outside may be selectively used as the damping part 600*a*. Furthermore, the damping part 600*a* can be changed to another component capable of generating an elastic restoring force.

Figure 10:
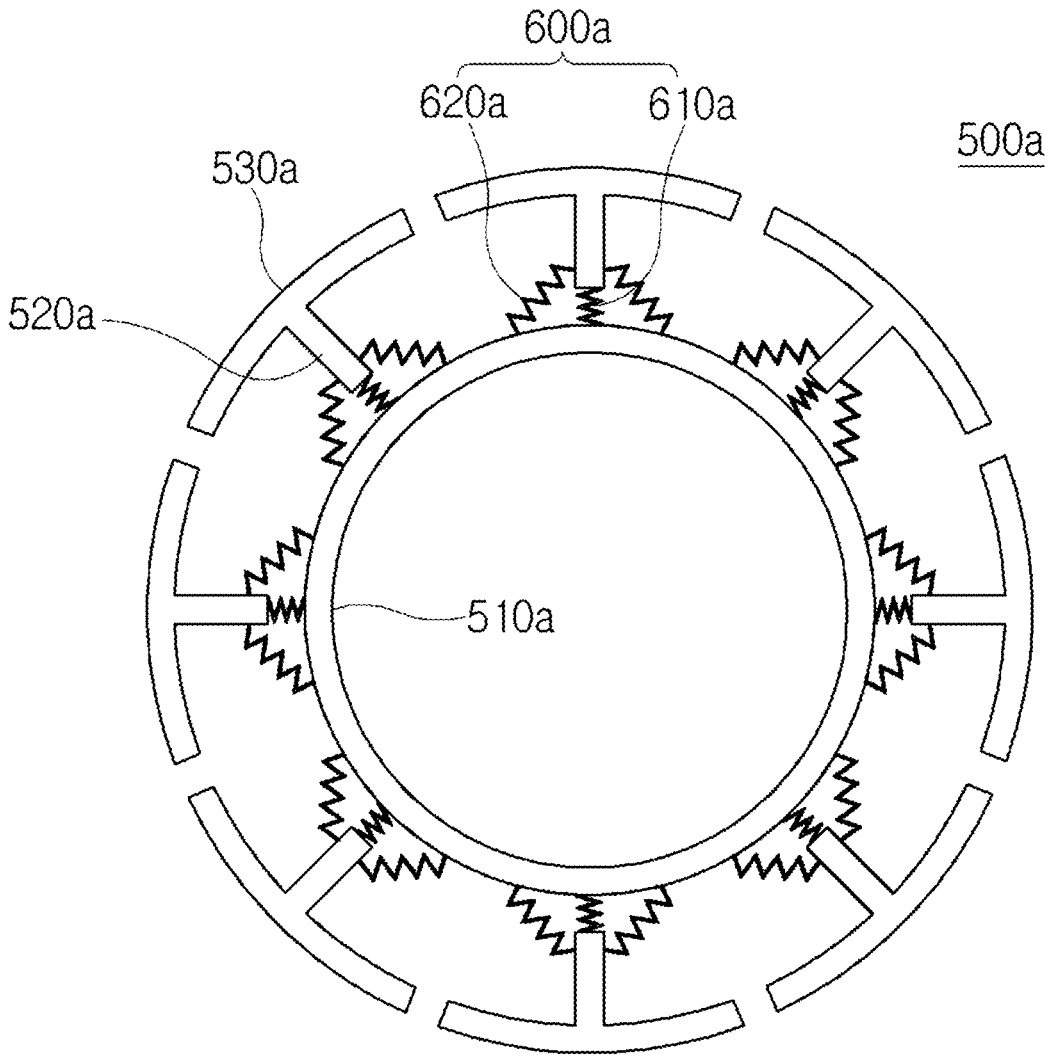

Referring to FIG. 10, the damping part 600*a* according to the present embodiment includes a first damping part 610*a* having one end fixed to the lower end of the extension 520*a* and the other end fixed to the outer circumferential surface of the inner ring 510*a*.

The first damping part 610*a* may be inserted and coupled to the outer circumferential surface of the inner ring 510*a*. In this case, the lower end of the first damping part 610*a* is partially inserted into the inner ring 510*a* and then fixed through welding.

When the first damping part 610*a* is implemented with a coil spring or plate spring, the first damping part 610*a* can damp an external force applied in the radial direction of the inner ring 510*a* from the stiffener 530*a* and an external force applied in the circumferential direction of the inner ring 510*a* at the same time. Therefore, the damping performance can be improved in various directions in which external forces are applied.

The damping part 600*a* further includes second damping parts 620*a*. One ends of the second damping parts 620*a* are connected to the left and right side surfaces of the extension 520*a*, respectively, and the other ends thereof are fixed to the outer circumferential surface of the inner ring 510*a*.

The second damping parts 620*a* are connected to the left and right side surface surfaces of the extension 520*a* with the first damping part 610*a*. The second damping parts 620*a* may be configured to have the same spring constant at the left and right surfaces of the extension 520*a* based on FIG. 10.

In the present embodiment, any one of a spring and plate spring which can damp a force applied from outside may be selectively used as the damping part 600*a*. Furthermore, the damping part 600*a* can be changed to another component capable of generating an elastic restoring force.

Figure 11:
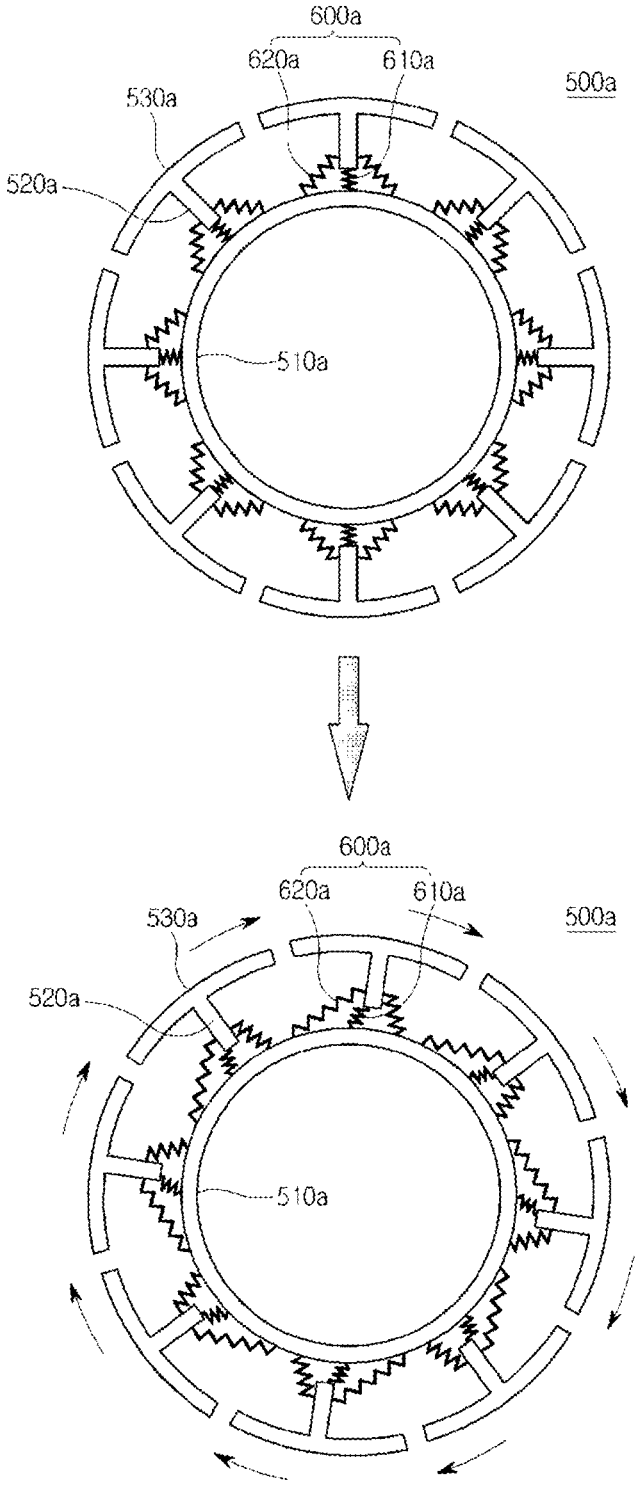
FIG. 11 illustrates an operation state of the clamping member according to the second embodiment of the present invention.

Referring to FIG. 11, when the second damping part 620*a* positioned at the left side of the extension 520*a* based on FIG. 11 is compressed by an external force, the second damping part 620*a* positioned at the right side of the extension 520*a* is extended to damp an external force as indicated by an arrow. On the other hand, when the second damping part 620*a* positioned at the right side of the extension 520*a* is compressed, the second damping part 620*a* positioned at the left side of the extension 520*a* may be extended to stably damp an external force generated in the circumferential direction.

Therefore, since the external force applied from the stiffener 530*a* is primarily damped through the extension 520*a* by the first damping part 610*a* and the external force generated in the circumferential direction of the inner ring 510*a* is damped by the second damping part 620*a*, the damping performance is improved.

The first and second damping parts 610*a* and 620*a* according to the present embodiment may be configured to retain different elastic restoring forces. In this case, the elastic restoring force of the first or second damping part 610*a* or 620*a* located at a position where damping is specifically required depending on the rotation of the tie rod 400 may be differently set.

The damping part 600*a* may be extended in a zigzag manner toward the extension 520*a* from the inner ring 510*a*, and retain a width and thickness corresponding to the width of the inner ring 510*a*.

When the damping part 600*a* has a width and thickness corresponding to the width of the inner ring 510*a*, the damping part 600*a* can damp most of an external force applied to the stiffener 530*a* even though the damping performance differs depending on the magnitude of the external force.

The damping part may include a metal or high-elasticity metal capable of retaining an elastic restoring force, and not be limited to a specific material.

According to the embodiments of the present invention, the gas turbine can damp vibration generated therein, minimize a damage of the components, which may be caused by the vibration and shock, and perform cooling to minimize a problem caused by overheating.

Furthermore, the gas turbine can damp shock and vibration transferred in the radial or axial direction through rotation of the tie rod.

While the present invention has been described with respect to the specific embodiments, it will be apparent to those skilled in the art that various changes and modifications may be made without departing from the spirit and scope of the invention as defined in the following claims.

What is claimed is:

1. A gas turbine comprising:

a compressor rotor including a plurality of compressor rotor disks;

a turbine rotor including a plurality of turbine rotor disks;

a connection part connecting the compressor rotor and the turbine rotor to each other and having a cavity through which cooling air passes from the compressor rotor disks to the turbine rotor disks;

a tie rod extended through central axes of the plurality of compressor rotor disks and central axes of the plurality of turbine rotor disks; and a clamping member configured to be disposed in the cavity of the connection part and forced onto the tie rod in an axial direction of the tie rod so as to be immobile in a radial direction of the tie rod and rotated with the tie rod, the clamping member being rotatable relatively with respect to an inner circumferential surface of the connection part and comprising:

an inner ring that is pressed against an outer circumferential surface of the tie rod and is disposed in an axial space corresponding to a predetermined axial length of the tie rod, the axial space extending radially outward from the tie rod;

a plurality of stiffeners disposed in the axial space and arranged in a circumferential direction of the tie rod to form a concentric circle around a center of the inner ring, the plurality of stiffeners having an axial length equal to the predetermined axial length of the tie rod; and a plurality of support parts respectively connected to each stiffener and to an outer circumferential surface of the inner ring, wherein each of the plurality of stiffeners has an inner circumferential surface facing the outer circumferential surface of the inner ring, the plurality of stiffeners being separated from each other by a clearance, and wherein the clamping member is configured to pass a first portion of the cooling air between the inner circumferential surfaces of the stiffeners and the outer circumferential surface of the inner ring and to simultaneously pass a second portion of the cooling air through the clearance while the passing second portion of the cooling air makes contact with the inner circumferential surface of the connection part.

2. The gas turbine of claim 1, wherein the plurality of support parts are arranged at predetermined intervals along the outer circumferential surface of the inner ring.

3. The gas turbine of claim 2, wherein the support parts are obliquely extended from the inner ring toward the respective stiffeners, when the clamping member is seen from the front.

4. The gas turbine of claim 2, wherein the support parts are extended from the circumferential direction of the inner ring toward the respective stiffeners in a normal direction perpendicular to the circumferential direction, and wherein each of the support parts includes a radial inner end and a radial outer end, each of the radial inner end and the radial outer end occurring on one normal line intersecting the outer circumferential surface of the inner ring and the inner circumferential surface of a corresponding stiffener of the plurality of stiffeners.

5. The gas turbine of claim 2, wherein the stiffeners have a slope corresponding to a slope of the inner circumferential surface of the connection part.

6. The gas turbine of claim 2, wherein the stiffeners are top-bottom and left-right symmetrical with respect to the center of the inner ring.

7. The gas turbine of claim 2, wherein each of the stiffeners maintains a clearance from another neighboring stiffener.

8. The gas turbine of claim 7, wherein the plurality of stiffeners have the same clearance therebetween.

9. The gas turbine of claim 7, wherein the clearance is decreased toward the turbine rotor.

10. The gas turbine of claim 2, wherein the inner ring has a plurality of grooves formed in the circumferential direction thereof, such that the support parts are inserted into the respective grooves.

11. The gas turbine of claim 2, wherein each support part of the plurality of support parts is connected to a corresponding stiffener of the plurality of stiffeners at a circumferential center of the inner circumferential surface of the corresponding stiffener, the corresponding stiffener extending circumferentially from either side of the circumferential center.

12. The gas turbine of claim 2, wherein a surface of the stiffener, which is relatively rotated with respect to the connection part, is processed to have low surface roughness.

13. A clamping member for a gas turbine comprising a compressor rotor including a plurality of compressor rotor disks; a turbine rotor including a plurality of turbine rotor disks; a connection part connecting the compressor rotor and the turbine rotor to each other and having a cavity through which cooling air passes from the compressor rotor disks to the turbine rotor disks; and a tie rod extended through central axes of the plurality of compressor rotor disks and central axes of the plurality of turbine rotor disks, the clamping member comprising:

an inner ring that is pressed against an outer circumferential surface of the tie rod and is disposed in an axial space corresponding to a predetermined axial length of the tie rod, the axial space extending radially outward from the tie rod; and a plurality of stiffeners disposed in the axial space and arranged in a circumferential direction of the tie rod to form a concentric circle around a center of the inner ring, the plurality of stiffeners having an axial length equal to the predetermined axial length of the tie rod, wherein each of the plurality of stiffeners has an inner circumferential surface facing an outer circumferential surface of the inner ring, the plurality of stiffeners being separated from each other by a clearance, wherein the clamping member is configured to be forced onto the tie rod in an axial direction of the tie rod such that the clamping member rotates together with the tie rod and rotates relative to an inner circumferential surface of the connection part, and wherein the clamping member is configured to pass a first portion of the cooling air between the inner circumferential surfaces of the stiffeners and the outer circumferential surface of the inner ring and to simultaneously pass a second portion of the cooling air through the clearance while the passing second portion of the cooling air makes contact with the inner circumferential surface of the connection part.

14. A gas turbine comprising:

a compressor rotor having a plurality of compressor rotor disks installed therein;

a turbine rotor having a plurality of turbine rotor disks installed therein;

a connection part connecting the compressor rotor and the turbine rotor to each other;

a tie rod extended through central axes of the plurality of compressor rotor disks and central axes of the plurality of turbine rotor disks; and a clamping member forced onto the tie rod in an radial direction of the tie rod so as to be rotated with the tie rod, and relatively rotated with respect to an inner circumferential surface of the connection part, wherein a cooling air is moved from the compressor rotor to the turbine rotor through an axial inside of the clamping member and an circumferential edge of the clamping member at the same time, wherein the clamping member comprises:

an inner ring pressed against an outer circumferential surface of the tie rod;

a plurality of support parts arranged at predetermined intervals such that one ends thereof are connected to an outer circumferential surface of the inner ring and the other ends thereof are extended toward an outside along a circumferential direction of the inner ring; and a plurality of stiffeners connected to the other ends of the support parts, respectively, and arranged along the circumferential direction of the inner ring while forming a concentric circle around a center of the inner ring, wherein each of the stiffeners maintains a clearance from another neighboring stiffener, and wherein the clearance is decreased toward the turbine rotor.

* * * * *